United States Patent [19]

Green

[11] Patent Number: 4,492,486

[45] Date of Patent: Jan. 8, 1985

[54] SCOOP COATER

[75] Inventor: Melvin E. Green, Chicago, Ill.

[73] Assignee: Advance Process Supply Co., Chicago, Ill.

[21] Appl. No.: 406,691

[22] Filed: Aug. 9. 1982

[51] Int. Cl.[3] ..... B05C 1/00; B41F 15/02; B41L 13/18

[52] U.S. Cl. ..... 401/131; 15/236 R; 101/114; 401/6; 401/139; D18/14; D25/74

[58] Field of Search ..... 401/5, 6, 130, 131, 401/139, 161, 162; D25/74; D18/14, 22; 15/236 R; 101/114, 119, 120, 123, 124

[56] References Cited

U.S. PATENT DOCUMENTS

| | | | |
|---|---|---|---|
| 16,021 | 11/1856 | Phillips | 401/139 |
| 427,897 | 5/1890 | Palson | 401/131 |
| 1,101,541 | 6/1914 | Harrington | 15/236 R |
| 1,297,361 | 3/1919 | Kerner | 401/261 |
| 1,841,163 | 1/1932 | Trane | 15/236 R |
| 2,338,647 | 1/1944 | Koon | 15/236 R |
| 2,711,098 | 6/1955 | Ames | 401/6 |
| 2,739,530 | 3/1956 | McLaurin | 101/123 |
| 3,203,021 | 8/1965 | Pelick | 401/5 |
| 3,451,757 | 6/1969 | Stroud | 401/139 |
| 4,243,336 | 1/1981 | McMullan | 401/6 |

FOREIGN PATENT DOCUMENTS

| | | | |
|---|---|---|---|
| 831659 | 2/1952 | Fed. Rep. of Germany | 15/226 R |
| 65919 | 6/1950 | Netherlands | 401/5 |

OTHER PUBLICATIONS

Reynolds; Designing With Aluminum Extrusions; 1958, pp. 6 and 7, (FIG. 4 in particular); Reynolds Metal Co.

*Primary Examiner*—Clyde I. Coughenour
*Attorney, Agent, or Firm*—Fitch, Even, Tabin & Flannery

[57] ABSTRACT

An improved scoop coater for manual application of emulsions to screens in the screen printing industry is formed inexpensively from metal extrusions and is configured to provide good handling characteristics when applying an emulsion coating. The scoop coater includes a one-piece extruded metal body having a trough-shaped portion for holding liquids and two upstanding extruded metal end walls which are attached to opposite ends of the trough-shaped portion of the body. Two legs and a handle projecting from the trough-shaped portion of the body have beads which provide improved fingerholds along their edges. Guide surfaces formed on the end walls function to keep the scoop coater at an optimal inclination toward a screen during use. An extruded metal cover is provided to cover emulsion in the trough between usages of the scoop coater.

4 Claims, 6 Drawing Figures

SCOOP COATER

The present invention relates generally to manual applicators for the application of emulsions to screens in the screen printing industry, these applicators commonly being called "scoop coaters", and relates more particularly to a scoop coater providing improved handling characteristics and performance.

One commercial scoop coater is made of a body having a trough-shaped portion with sloped sides converging at the bottom of the trough to give it a V-shaped cross-section, and two upstanding triangular end walls which retain fluid in the trough. Extending along the edge of one side of the body is a lip over which the emulsion flows as it is applied to an inclined screen as described below. A leg projecting from the lower surface of this side of the body extends along the length of the body so that the scoop coater can stand in a stable, upright position on a flat surface, resting on the bottom of the trough-shaped portion of the body and the leg. The opposite side of the body has its edge turned downward to form a handle for the scoop coater.

In use the scoop coater is held in one hand. To apply emulsion to an inclined screen, the user puts his thumb on top of the handle and places two or more fingers around the bottom of the trough, positions the scoop coater so that the lip touches the screen, tilts the scoop coater toward the screen to permit the emulsion to contact the screen, and moves the scoop coater upward with the lip sliding along the surface of the screen. Emulsion flows over the lip to coat the screen as the scoop coater is moved upward along the screen. The angle at which the scoop coater is held during application affects the quality of the emulsion. If the scoop coater is tilted too far toward the screen, excess emulsion flows laterally from the ends of the lip. If it is not tilted far enough, the emulsion may be applied with insufficient thickness. It is desirable that the inclination of the scoop coater remain constant during an application.

One of the disadvantages of this commercial scoop coater design is that a comfortable, secure grip is difficult to maintain during use. Another disadvantage is that it is difficult for a user to maintain a constant inclination of the scoop coater during an application of emulsion.

Two further disadvantages of this scoop coater relate to the end walls, which are attached so that the ends of the body extend beyond the end walls. The first problem is that during use, capillary action tends to draw the emulsion laterally to the ends of the lip beyond the end walls and result in a coating which exceeds the desired width and is of non-uniform thickness at its edges. The second disadvantage is that the end walls are made from metal castings and have certain surfaces machined to provide a smoother finish. The expense of machining increases the cost of the scoop coater.

A further shortcoming of this commercial scoop coater is that cleaning of the scoop coater between uses is difficult due to accumulation of residual emulsion at the bottom of the V-shaped trough portion of the body.

Accordingly, it is an object of the present invention to provide a new and improved scoop coater which is inexpensive to manufacture and has improved handling characteristics.

Other objects and advantages of the present invention will become obvious from the following detailed description and the accompanying drawing in which.

Figure 1:
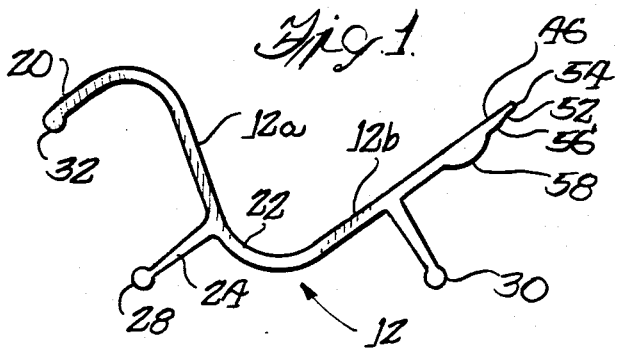
FIG. 1 is an end elevational view of the body of a scoop coater embodying the present invention.

The present invention is generally embodied in a scoop coater 10 having a trough-shaped body 12 and two end walls 14 and 16 attached thereto. A lip 18 extends along one edge of the body and a curved handle 20 extends along the opposite side.

Disadvantages of scoop coaters presently in use include difficulty in maintaining a comfortable, secure grip during use; lack of a means for keeping the scoop coater at a constant inclination to the screen during use; the cost of machining surfaces of the cast end walls; flow of emulsion to the ends of the lip due to capillary action during use; and difficulty in cleaning leftover emulsion from the trough.

In accordance with the present invention, a new and improved scoop coater 10 is formed inexpensively from metal extrusions and is configured to provide good handling characteristics to apply an emulsion coating. To these ends, the scoop coater includes a one-piece extruded metal body 12 and two upstanding extruded metal walls 14 and 16 which are attached to opposite ends of the body. The upper surface of the body defines a trough of improved shape, having a bottom 22 curved at a relatively large radius to facilitate cleaning. Two legs 24 and 26 are formed projecting from the lower surface of the body 12 and extending along its length. The extruded parts are lightweight, and the extrusion process leaves their surfaces smooth enough that no finishing is required prior to assembly.

One-handed gripping and manipulation of the scoop coater are facilitated by beads 28, 30, and 32 which extend along the extreme edges of the legs 24 and 26 and handle 20, and which function as fingerholds. The beads provide a substantial improvement in the handling characteristics of the scoop coater by making it easier for the user to prevent it from slipping from his hand or shifting during use. The beads need really to be felt to understand the improved holding characteristics achieved by them.

It is preferred to keep the scoop coater at a constant angle as it is moved up a screen, and to this end, guide surfaces 34 and 36 for sliding contact with the screen are formed on the vertical end walls 14 and 16. The guide surfaces 34 and 36 are oriented so that when they are flush aganst the screen the lip 18 of the scoop coater is oriented at an optimal angle for application of fluid to the screen. Rounded corners 38 and 40 at the leading ends of the guide surfaces 34 and 36 prevent damage to the screen as the guide surfaces slide upward along the screen.

Figure 3:
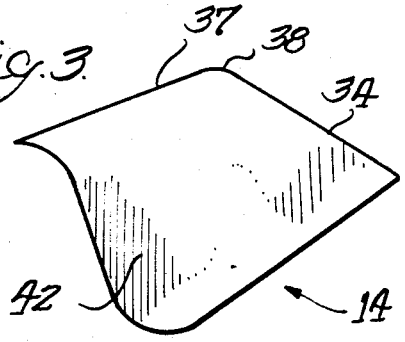
FIG. 3 is an end elevational view of an end wall of a scoop coater embodying the present invention.
Figure 4:
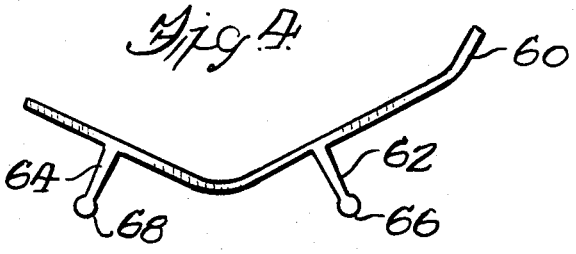
FIG. 4 is an end view of a cover for the scoop coater of FIG. 5.

The end walls 14 and 16 are positioned so that their externally facing surfaces 42 are flush with the ends 44 of the body. This positioning of the end walls has been found to prevent the undesirable capillary action described above. The end walls 14 and 16 are identical and are preferably cut slices from an elongated metal extrusion having a cross-sectional shape such as the shape shown in FIG. 3.

Turning now to a more detailed description of the preferred embodiment of the present invention, the preferred scoop coater body 12 is a one-piece trough-shaped aluminum extrusion preferably of aluminum or other lightweight alloys with two flat sides 12*a* and 12*b* oriented at an angle of approximately 75° to one another and joined by the rounded bottom 22 of the trough. The handle 20 extending along the top of one side 12*a* is angled at about 75° to the flat side 12*a*. To provide sufficient strength and rigidity while keeping material cost and weight low, the thickness of the aluminum is approximately 0.085 in. over most of the scoop coater body 12.

The legs 24 and 26 have approximately the same thickness where they meet the underside of the trough-shaped portion of the body and taper to a lesser thickness near the beads 28 and 30 at their ends. The preferred beads 28, 30 and 32 are cylindrical in shape with ⅛ inch diameters. The preferred end walls 14 and 16 are aluminum extrusions approximately ¼ in. thick and are attached to the body by screws or bonding material (not shown) so that their outer surfaces 42 are flush with the ends of the body 44.

In use the scoop coater may be held with the user's thumb on top of the handle 20 and two or more fingers around the beads 28 at the bottom of the leg 24 nearest the handle. To apply emulsion to a screen the user places the lip 18 against the screen, tilts the scoop coater toward the screen so that the guide surfaces 34 and 36 rest against the screen, and moves the scoop coater upward along the screen, keeping the guide surfaces 34 and 36 and lip 18 in sliding contact with the screen.

The quality of the emulsion coating is best if the upper surface 46 of the lip is inclined toward the screen during use at an angle of between 51° and 81°. The guide surfaces 34 and 36 in the preferred embodiment are oriented at 66° angle to the upper surface 46 of the lip so that the angle between the upper surface of the lip and the screen will be 66°, which is midway between 51° and 81°. To minimize the possibility of damage to the screen by the guide surfaces 34 and 36, round corners 38 and 40 are formed on their leading ends.

The preferred guide surfaces 34 and 36 are 1¼ in. long and approximately ¼ in. wide. The rounded corners at their leading ends define a ¼ inch radius and form an angle of about 51° between the guide surfaces 34, 36 and the adjacent surfaces 35, 37 on the end walls.

Figure 2:
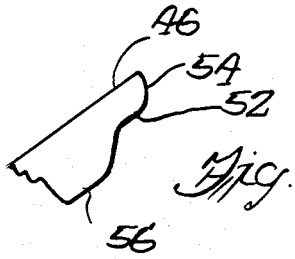
FIG. 2 is an enlarged end elevational view of the lip of the body of FIG. 1.
Figure 5:
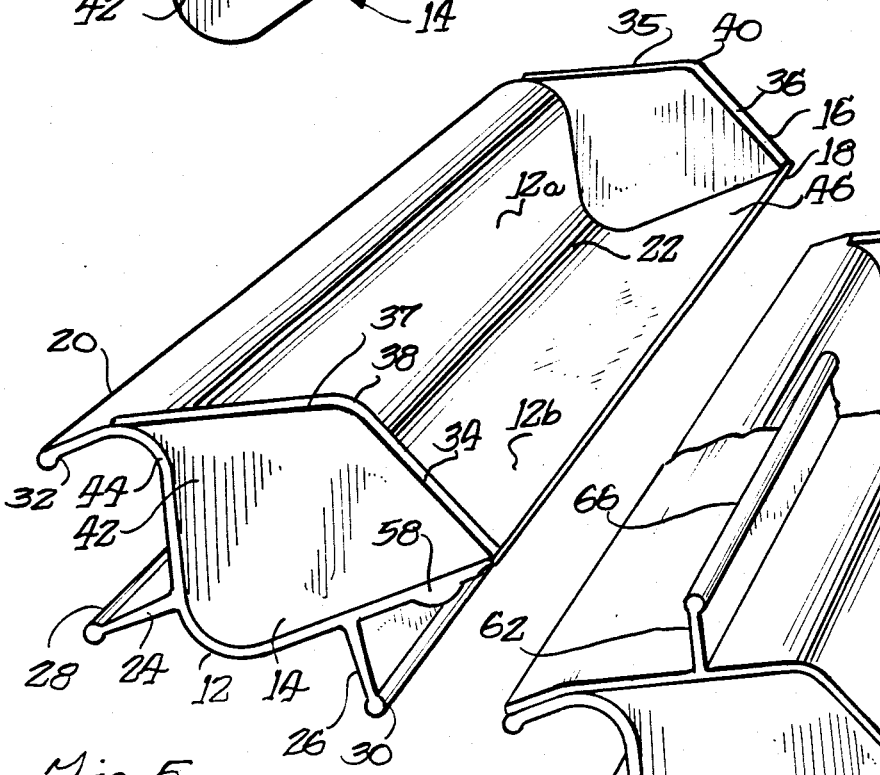
FIG. 5 is a perspective view of a scoop coater embodying the present invention.
Figure 6:
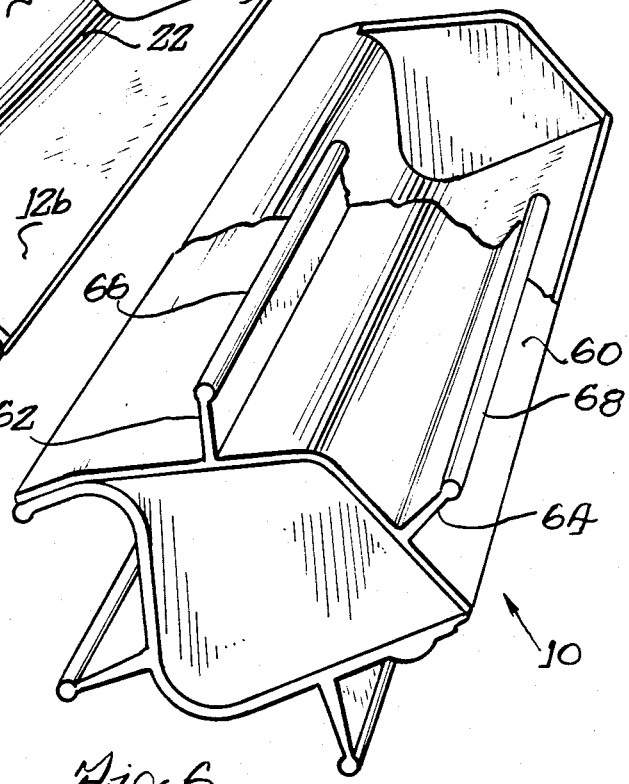
FIG. 6 is another perspective view of the scoop coater of FIG. 5 showing a cover thereupon, with a portion of the cover cut away.

To apply an emulsion of uniform thickness the lip 18 should be straight and free from any dents, nicks or warpage which would cause uneven flow. The shape of the lip 18 affects the thickness of the emulsion. As best seen in FIG. 2, the upper surface 46 of the lip is flat. The end 52 of the lip has thickness of 0.038 in., and the lower corner 54 of the end 52 has a radius of 1/32 inch. To provide strength and rigidity the lower surface is inclined to form a thicker portion 56 of the lip, and a rib 58, best seen in FIGS. 1 and 5, adjacent thereto extends along the lower surface of the body 12.

Cleaning of the trough portion of the body is facilitated by forming the bottom 22 of the inside of the trough with a radius of approximately ⅜ in.

To prevent dust and debris from contaminating the emulsion while the scoop coater is standing between uses, an extruded metal cover 60 may be used and fited over the top of the scoop coater. Two handles 62 and 64 with beads 66 and 68 formed at their ends facilitate manual handling of the cover.

In summary, the present invention provides an improved scoop coater which is inexpensive to manufacture and offers improved performance. While the preferred embodiment has been shown and described, there is no intent to limit the invention by this disclosure.

What is claimed is:

1. A scoop coater for use in application of emulsion to screens for screen printing operations, the scoop coater comprising:

an extruded metal body having a trough portion for holding liquids, two legs projecting downwardly from the underside of the trough-shaped portion of the body, a handle extending along one side of the body, a lip extending along the opposite edge of the body, said body being asymmetrical with the trough having sides of different lengths, two upstanding extruded metal end walls attached to the body to define a hollow reservoir, a bead extending along each of the legs and handle to facilitate manual handling of the scoop coater, guide surfaces formed on the end walls for sliding contact with a screen to aid in positioning the scoop coater at a preferred angle with respect to the screen during use and having rounded corners formed at the leading ends of the guide surfaces to prevent damage to the screen, said end walls being asymmetrical in shape and having first and second portions meeting at a pointed intersection, the angle between the plane of the guide surfaces and the plane of the upper surface of the trough at the lip is between 51° and 81°.

2. A scoop coater in accordance with claim 1 wherein the bottom of the trough is curved at a relatively large radius to facilitate cleaning of the bottom of the trough.

3. A scoop coater in accordance with claim 1 wherein the end walls are formed of metal extrusions and are attached to the body of the scoop coater so that the exterior facing surfaces of the end walls are flush with the ends of the body.

4. A scoop coater for use in application of emulsion to screens during screen printing operations, the scoop coater comprising:

an extruded metal body having a trough-shaped portion for holding liquids, two legs projecting downwardly from the underside of the trough-shaped portion of the body, a handle extending along one edge of the body, and a lip extending along the opposite side of the body, each of the legs and handle having a bead extending along its extreme edge to facilitate manual handling of the scoop coater, two upstanding extruded metal end walls attached to the body, the end walls being attached to the body so that their externally facing surfaces are flush with the ends of the body, the end walls having guide surfaces formed thereon for sliding contact with a screen wherein the angle between the plane of the guide surfaces and the plane of the upper surface of the trough at the lip is between 51° and 81°, the end walls having rounded corners formed at the leading ends of the guide surfaces to prevent damage to the screen, and a cover for the scoop coater.

* * * * *